United States Patent [19]

Shiga

[11] Patent Number: 4,643,600

[45] Date of Patent: Feb. 17, 1987

[54] STABILIZING DEVICE FOR HAMMER BOUNDING AT PRINTERS

[75] Inventor: Norio Shiga, Chofu, Japan

[73] Assignee: Tokyo Juki Industrial Co., Ltd., Chofu, Japan

[21] Appl. No.: 834,962

[22] Filed: Feb. 28, 1986

[30] Foreign Application Priority Data

Feb. 28, 1985 [JP] Japan ..... 60-29112[U]

[51] Int. Cl.[4] ..... B41J 9/02; B41J 9/38

[52] U.S. Cl. ..... 400/157.2; 101/93.29; 101/93.48; 101/93.02; 267/137; 267/153; 400/686

[58] Field of Search ..... 400/157.1, 157.2, 157.3, 400/457, 686, 918; 101/93.28–93.36, 93.48, 93.02; 267/153, 137, 140, 141; 188/276; 428/212, 217, 218, 522, 424.6

[56] References Cited

U.S. PATENT DOCUMENTS 4,505,604 3/1985 Takemoto ..... 400/157.2 X
4,530,280 7/1985 Kaneko et al. ..... 400/157.2 X

FOREIGN PATENT DOCUMENTS 163680 9/1983 Japan ..... 400/157.2

OTHER PUBLICATIONS

"Backstop for Electromagnetic Actuators" by Helinski, *IBM Technical Disclosure Bulletin,* vol. 27, No. 7B, 12/1984, pp. 4290–4291.

"Backstop for Electromagnetic Actuators", *Research Disclosure,* Dec. 1984, Number 248.

*Primary Examiner*—Edgar S. Burr
*Assistant Examiner*—Moshe I. Cohen
*Attorney, Agent, or Firm*—Morgan & Finnegan

[57] ABSTRACT

A stabilizing device containing two bonded elastomeric materials with restitution coefficients that vary inversely with temperature changes. The resultant restitution coefficient of the printer hammer back-stopper remains relatively constant regardless of temperature variations in the back stopper caused by heat generated by the operation of a hammer solenoid.

1 Claim, 6 Drawing Figures

STABILIZING DEVICE FOR HAMMER BOUNDING AT PRINTERS

BACKGROUND OF THE INVENTION

The invention relates to print hammer operation in printers, and more particularly, to a device that stabilizes rebounding of the print hammer during printer operation.

A conventional plunger-type printer is illustrated in FIG. 5. A sectional view of the mechanical configuration of such a printer illustrates a platen (2), a sheet of paper (3), and a ribbon (4) inserted between a type character (5) and the paper (3). A daisy-wheel (6) which provides type characters at its circumference frame (7) holds and positions the print hammer (9). Print hammer (9) has an end (12), a tip (10), a spring stopper (11) and is driven by a solenoid hammer coil (13). Front flange (14) and rear flange (15) support the print hammer (9).

In the prior art system illustrated by FIG. 5, a spring (16) is installed between the spring stopper (11) of the print hammer (9) and the front flange (14). Back-stopper (17) controls the print hammer's rebound action.

In this configuration, when the solenoid coil (13) drives the hammer (9), the tip (10) pushes the type character (5) against the ribbon (4), printing the character on the paper (3). Spring (16) is compressed during this time. After printing the character, spring (16) restores hammer (9) to its original position. Printing is thus performed by the reciprocating action of hammer (9).

Where a plunger-type print hammer is used in daisy-wheel printers, the temperature at the print hammer back-stopper may rise between 50 and 70 degrees Celsius during operation. However, the restitution coefficient of the material used for the back-stopper in conventional printers varies as the temperature varies, as illustrated in FIG. 6. Many kinds of elastomers are selected for use as back-stoppers. However, in conventional printers, when the print hammer (9) is restored to its original position by the force of the spring (16) after the printing action, a strong rebounding action may take place when the rear end of the print hammer (9) strikes the back-stopper (17), especially when the coefficient of restitution has increased. This hammer rebounding may cause the print hammer to restrike the type character (5) and interfere with the movement of the type (5). A back stopper material whose coefficient of restitution did not vary with its temperature would eliminate these problems, but it was difficult to find such kinds of materials.

It is therefore an object of the invention to stabilize the rebounding action of a print hammer despite rising temperatures of the print hammer and back-stopper.

It is a further object of the invention to provide a back-stopper material whose restitution coefficient does not significantly vary with its temperature and thus does not impair the printer's operation.

SUMMARY OF THE INVENTION

These and other objects of the invention are met by providing a stabilizing device for a print hammer, including two elastomeric materials having restitution coefficients that vary inversely with respect to each other as the temperature changes. The chosen elastomers are bonded together and are used as a print hammer's back-stopper. The back-stopper is installed at the rear of a sleeve in the print hammer driving mechanism that guides the hammer in its operation. The invention overcomes the temperature variable rebounding of the hammer, thus avoiding print hammer type restriking and hammer interference with type transference, thereby assuring a more stable print hammering action.

BRIEF DESCRIPTION OF THE DRAWINGS

The invention will be described in greater detail below by way of reference to the following drawings, in which.

DETAILED DESCRIPTION OF THE DRAWINGS

Referring to the accompanying drawings, one embodiment of the present invention will be explained herein.

Figure 1:
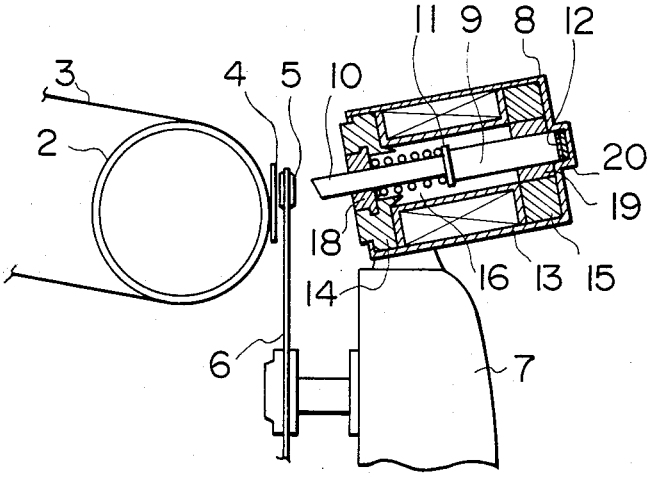
FIG. 1 is a sectional view of one embodiment of a print hammer stabilizing device according to the invention.

FIG. 1 is a sectional view of one embodiment of the invention, including a platen (2), a sheet of paper (3), and a ribbon (4) inserted between a type character (5) and the paper (3). A daisy-wheel (6) that provides type characters at its circumference (5) is rotatably sustained at a frame (7). A sleeve (8) fixed to frame (7) holds and positions the print hammer. Print hammer (9) has an end (12), a tip (10), a spring stopper (11), and is driven by a solenoid hammer coil (13).

Figure 2:
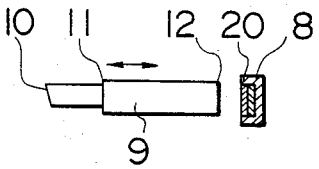
FIG. 2 is a partial drawing of an embodiment of the invention illustrating the function of a back-stopper in response to the motion of the print hammer.
Figure 3:
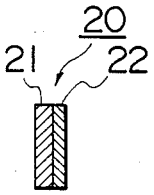
FIG. 3 is a sectional view of the back-stopper of FIG. 2.
Figure 4:
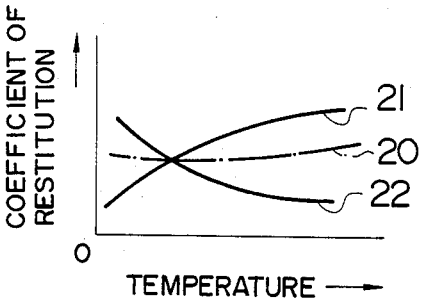
FIG. 4 illustrates the relationship between the temperature of the back-stopper and the coefficient of restitution of the back-stopper and of the individual component elastomeric materials that comprise the back-stopper.

A front guide (18) and a rear guide (19) are enclosed by a front flange (14) and a rear flange (15), and support and guide the movement of print hammer (9). Spring (16) is installed between the spring stopper (11) of print hammer (9) and front guide (18). A back-stopper (20), comprises two elastomers (21) and (22) bonded together as illustrated by FIGS. 2 and 3. The elastomers (21), (22) are chosen so that their restitution coefficients vary inversely with respect to each other as the temperature changes as illustrated in FIG. 4.

FIG. 2 illustrates the movement of print hammer (9) within guides (18) and (19) and against back-stopper (20).

FIG. 3 is an enlarged sectional view of back-stopper (20) illustrating its component bonded elastomers (21) and (22).

In this embodiment of the rebound stabilizing device, daisy wheel (6) is rotated to the desired position, and a drive signal is transmitted to solenoid hammer coil (13). Print hammer (9) moves from its original position, causing tip (10) to strike type character (5), forcing ribbon (4) against paper (3) backed by platen (2), leaving a printed character on the paper (3). As the print hammer (9) advances, spring (16) is compressed. After striking the type character (5), spring (16) restores the print hammer to its original position, driving print hammer (9) into back-stopper (20).

As stated above, elastomers (21) and (22) are chosen to have restitution coefficients that vary inversely, with respect to each other, with the temperature of the back-stopper as illustrated by FIG. 4.

Figure 5:
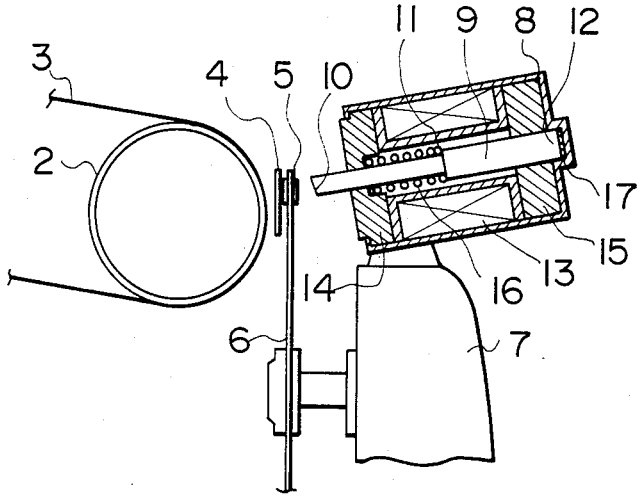
FIG. 5 PRIOR ART
FIG. 5 is a sectional view of a conventional print hammer striking device.
Figure 6:
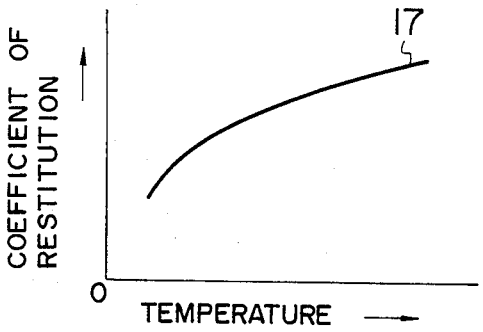
FIG. 6 illustrates the relationship in a conventional printer between the temperature of the backstopper and the coefficient of restitution of that back stopper.

FIG. 4 illustrates the temperature-restitution coefficients of a back stopper according to one embodiment of the invention, wherein first elastomer (21) is a butyl rubber with a restitution coefficient that rises as the temperature rises, and wherein second elastomer (22) is a soft chloride-vinyl with a restitution coefficient that falls as the temperature rises. The back-stopper (20) is made of elastomers (21) and (22) bonded together. In this invention, therefore, the resultant restitution coefficient of the back-stopper (20) is kept substantially constant regardless of temperature variation. This behavior contrasts with the varying coefficients of the back-stopper (17) in a conventional printer as illustrated in FIGS. 5 and 6. Thus, the invention stabilizes the rebounding action of the print hammer (9) off the back stopper (20).

Accordingly, the invention avoids the prior art problems associated with rising back-stopper temperatures and of the print hammer re-striking the type characters after printing or interfering with the movement of the type. The invention, on the other hand, allows more predictable and stable operation regardless of temperature variation.

As many apparently widely different embodiments of the invention may be made without departing from the spirit and scope thereof, it is to be understood that the invention is not limited to the specific embodiments herein described, except as defined in the claims that follow.

I claim:

1. A stabilizing device to prevent print-hammer rebounding in printers, comprising:

a driving mechanism that drives a print hammer;

a sleeve that encases said driving mechanism;

guides that guide the print hammer to its printing position; and a back-stopper installed within said sleeve and positioned at the end of said print hammer, said back-stopper having a coefficient of restitution which is substantially constant despite variation in temperature, said back-stopper comprising two elastomers bonded together, said elastomers having coefficients of restitution that vary inversely with respect to each other in response to temperature change.

* * * * *